US006839913B2

(12) United States Patent
Villalobos

(10) Patent No.: US 6,839,913 B2
(45) Date of Patent: Jan. 11, 2005

(54) ADJUSTABLE GARMENT WAISTBAND AND METHOD OF MANUFACTURE

(75) Inventor: Ora Zoe Villalobos, Irvine, CA (US)

(73) Assignee: Noble Ideas, Inc., Corona del Mar, CA (US)

( * ) Notice: Subject to any disclaimer, the term of this patent is extended or adjusted under 35 U.S.C. 154(b) by 218 days.

(21) Appl. No.: 10/180,481

(22) Filed: Jun. 25, 2002

(65) Prior Publication Data

US 2003/0233698 A1 Dec. 25, 2003

(51) Int. Cl.[7] ..... A41D 1/06
(52) U.S. Cl. ..... 2/227; 2/236; 2/238; 2/400
(58) Field of Search ..... 2/227, 228, 229, 2/236, 237, 238, 338, 400, 401, 402, 403, 406, 407, 409, 300, 311, 312, 404, 78.1, 79, 339, 341; 450/95, 99, 100, 107, 119, 121

(56) References Cited

U.S. PATENT DOCUMENTS

| | | | | | |
|---|---|---|---|---|---|
| 1,339,070 | A | * | 5/1920 | Sanders | 2/403 |
| 1,987,233 | A | * | 1/1935 | Goodman | 2/407 |
| 2,088,302 | A | * | 7/1937 | McKeever | 450/114 |
| 2,254,863 | A | | 9/1941 | Weihe | |
| 2,622,600 | A | | 12/1952 | De Guyot et al. | |
| 3,323,140 | A | * | 6/1967 | Morris | 2/227 |
| 4,176,408 | A | * | 12/1979 | de Polo | 2/69 |
| 4,400,832 | A | * | 8/1983 | Kinder | 2/406 |
| 4,731,882 | A | * | 3/1988 | Ekman | 2/69 |
| 5,289,590 | A | * | 3/1994 | Larson | 2/227 |
| 5,784,723 | A | * | 7/1998 | Noble et al. | 2/400 |
| 5,870,779 | A | * | 2/1999 | Heron | 2/403 |
| 5,974,592 | A | * | 11/1999 | Tabrizi | 2/400 |
| 6,058,514 | A | * | 5/2000 | Hart | 2/406 |
| RE36,905 | E | | 10/2000 | Noble et al. | |
| 6,360,375 | B1 | * | 3/2002 | Hart | 2/406 |

* cited by examiner

*Primary Examiner*—Amy B. Vanatta
(74) *Attorney, Agent, or Firm*—Orrick, Herrington & Sutcliffe LLP

(57) ABSTRACT

A figure defining and contouring garment, which outlines and defines a wearer's body contours in a fashionable and comfortable manner, includes a waistband coupled to a body with a rear tunnel that extends along the inside rear of the garment from the lower rise or crotch area to the waistband and a waistband tunnel that extends through the waistband. A drawstring anchored in the lower rise area extends upwardly through the rear tunnel to the waistband where it transitions to the waistband tunnel through a diverter region in the waistband. The drawstring transition between the rear and waistband tunnels is advantageously hidden within the waistband. The drawstring is used to adjust the fit of the garment by pulling on the drawstring to tighten the drawstring. In a preferred embodiment, the diverter region of the waistband is substantially fixed relative to the lower rise portion of the garment, which results in the rear tunnel and the center rear of the garment being drawn inwardly to define the contours of a wearer's body.

27 Claims, 7 Drawing Sheets

ADJUSTABLE GARMENT WAISTBAND AND METHOD OF MANUFACTURE

FIELD OF THE INVENTION

This invention relates to clothing, and more particularly to a garment waistband that facilitates adjustment in an adjustable garment.

BACKGROUND

Millions of men and women seek to improve their appearance on a daily basis. They try dieting or exercising, and some even try surgery in an attempt to improve the way they look. As an alternative or a supplement to dieting, exercising and surgery, many individuals have chosen to utilize a variety of garments that are marketed as figure enhancing tools.

Active wear clothing has emerged in an area of popularity for such garments. For example, certain shorts made from a stretch polyester or nylon knit-type fabric such as Lycra™ or Supplex™ are often marketed with the claim that the shorts will enhance a wearer's figure by improving the shape of the wearer's buttocks. Contrary to these claims, however, many of these garments are so tight that they flatten the wearer's buttocks instead of improving its shape. Because the shorts are so tight, in essence, they are a girdle and are uncomfortable to wear. For those shorts that fit comfortably, they do not enhance or outline the wearer's buttocks as claimed.

Figure defining and contouring garments described in U.S. Pat. No. Re. 36,905, which is incorporated by reference, provide for the desired definement of the contours of wearer's body in a comfortable manner. These figure defining and contouring garments utilize an adjustment system extending throughout a tunnel seam(s) extending from a lower back rise portion of the pants and divergently about the waist portion. In one design, drawstrings anchored in an inseam and rise junction area of the garment extend through a tunnel seam extending along the rear of the pants upwardly from the inseam and rise junction area to the waistband. At the waistband, the drawstrings diverge and are directed in opposite directions through a tunnel in the waistband. Tightening the drawstrings draws the rear tunnel seam inwardly to define the contours of the wearer's body. However, depending on the garment's construction, tightening of the drawstrings may cause the fabric in the rear of the garment to gather and bunch undesirably.

Therefore, it would be desirable to have a garment that provides the desired definition and contouring to the wearer's buttocks, and that is both comfortable to wear and fashionable.

SUMMARY OF THE INVENTION

The figure defining and contouring garment of the present invention serves to define a wearer's figure by further defining the wearer's body contours in a comfortable and fashionable manner. The garment preferably includes a waistband coupled to a body with a rear tunnel that extends along the inside rear of the garment and a waistband tunnel that extends through the waistband. The rear tunnel is preferably formed along a center rear rise seam and extends from the lower rise or crotch area to the waistband. A drawstring anchored in the lower rise or crotch area extends upwardly through the rear tunnel to the waistband where it transitions to the waistband tunnel through a diverter region in the waistband. To adjust the fit of the garment, a wearer pulls on the drawstring, tightening the drawstring to draw the rear tunnel and the rear of the garment inwardly to define the contour's of a wearer's body.

In one innovative aspect of the present invention, the drawstring transition between the rear and waistband tunnels is advantageously hidden within the waistband. In another innovative aspect of the present invention, the waistband comprises a diverter region that provides a sloping or tapering drawstring transition between the rear and waistband tunnels. In yet another innovative aspect of the present invention, the diverter region of the waistband and, thus, a transition or adjustment point within the waistband, is substantially fixed relative to the lower rise or crotch region of the garment. As a result, when the drawstring is tightened the rear tunnel and the center of the rear of the garment are drawn inwardly to define the contours of a wearer's body.

In a preferred embodiment, the waistband comprises an under waistband joined to a top or upper waistband, which may comprise a stabilizing layer formed of fusing material. The under waistband preferably comprises a main or under waistband self layer joined to a lining layer. A cover stitch detail is applied to the main and lining layers to form the diverter region and the waistband tunnel. Preferably, the diverter region is stabilized using fusing material. Alternatively, the waistband may comprise an under waistband joined to a top waistband with a waistband tunnel formed their between and a diverter joined to the under waistband.

Further objects and advantages of the present invention will become apparent from a consideration of the drawings and ensuing description.

DETAILED DESCRIPTION OF THE PREFERRED EMBODIMENT

Referring now in detail to the drawings, therein illustrated are preferred embodiments of a figure defining and contouring garment having a novel waistband that facilitates adjustment of the garment and a novel method of manufacture. Turning to FIGS. 1A–B, 2A–B, 3A–B and 4A–B, the figure defining and contouring garment is shown, for exemplary purposes only, as a pair of zip-up front-fly style pants 10 (FIGS. 1A–B and 2A–B) and a pair of pull-on style pants 100 (FIGS. 3A–B and 4A–B). Persons skilled in the art will understand that the figure defining and contouring garment of the present invention could be embodied as shorts, pants, briefs, swim wear, lingerie, and the like, in a pull-on style or a zip-up or closeable style with an exposed or hidden zipper or other fasteners or closures. Preferably, the main fabric of the garment, or the garment "self", is a stretchable or non-stretchable-type fabric, including, but not limited to, knit, woven, pile, plush or sueded-type fabrics, formed from natural and/or man-made fibers.

Figure 1B:
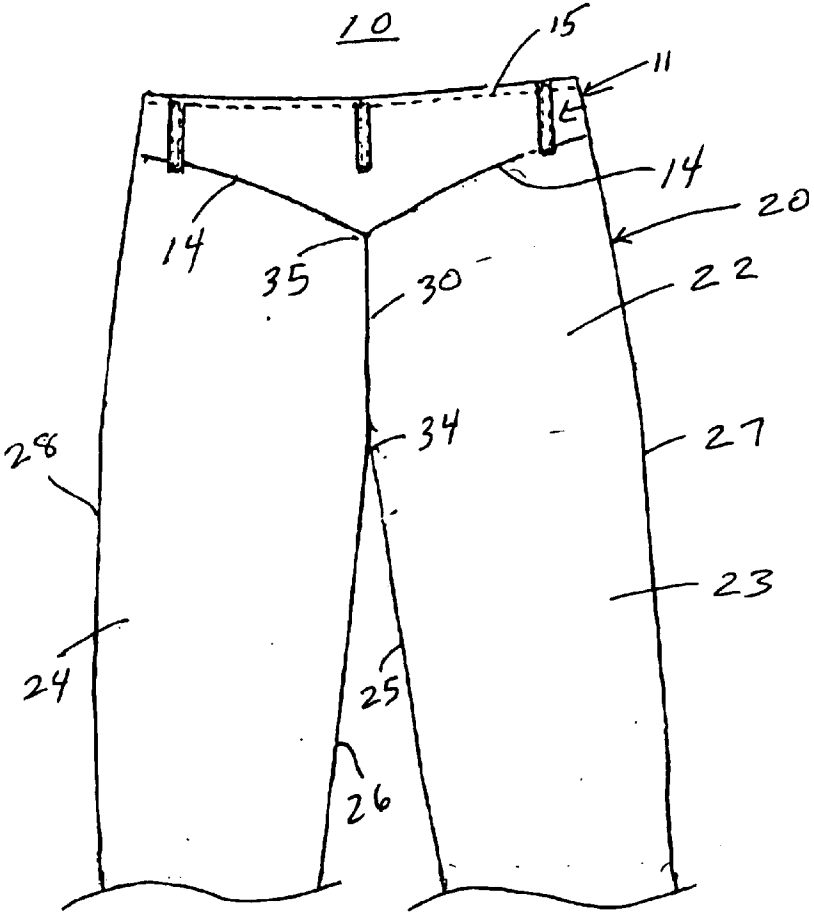
FIGS. 1A and 1B are front and back outside plan views of a pair of zip-up front fly style pants in accordance with the present invention.
Figure 1A:
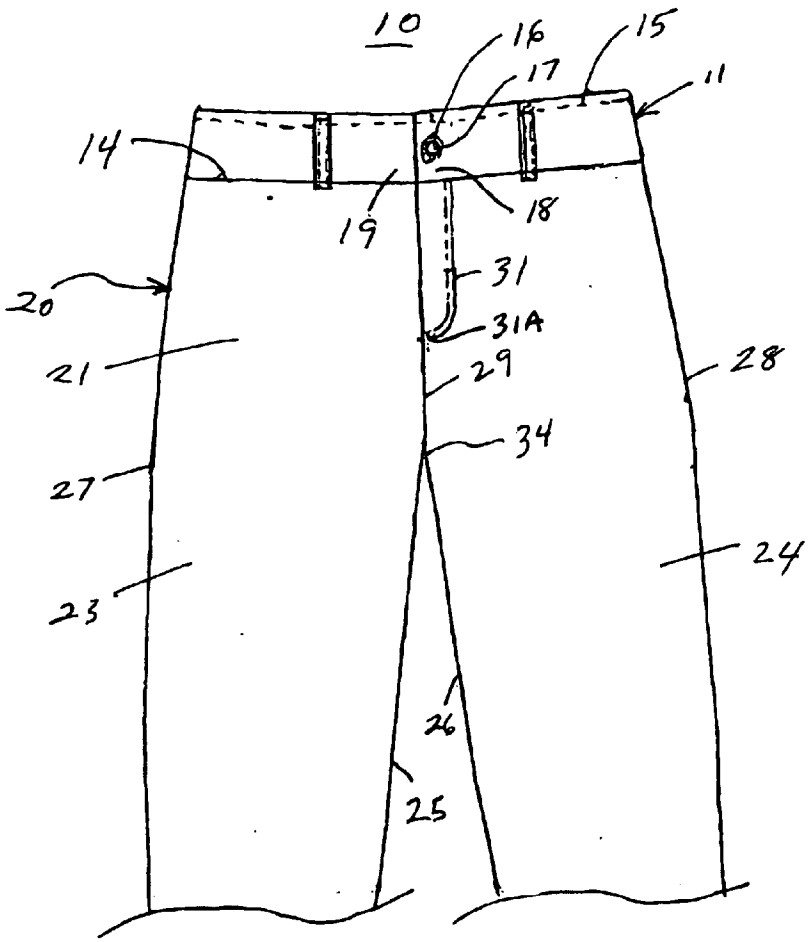

Turning to FIGS. 1A and 1B, which provide front and back outside views, the zip-up front-fly style pants 10 of the present invention comprise a waistband 11 connected to a main body 20 having front and rear portions 21 and 22. The front and rear portions 21 and 22 of the pants 10, which include right and left leg portions 23 and 24, are joined or sewn together forming right and left inseams 25 and 26, right and left side seams 27 and 28, and front and rear center rise seams 29 and 30. The waistband 11 is sewn to the top of the main body 20 of the pants 10 forming an attachment seam 14.

The front center rise seam 29 of the pants 10 extends from an inseam and rise junction or crotch area 34, where the front and rear rise seams 29 and 30 and right and left inseams 25 and 26 meet, to a base 31 A of a front fly 31. The fly 31, which preferably includes an inner fly extension 32 (see FIG. 2A) and a zipper, or other fasteners or closures, to close the fly 31, extends from the front center rise seam 29 to the waistband 11. The rear center rise seam 30 also extends from the inseam and rise junction area 34 to the waistband 11 where it intersects the attachment seam 14. As depicted in FIG. 1B, the attachment seam 14 and, thus, the waistband 11 preferably slope downwardly in the rear of the pants 10 to a point 35 where the center rear rise seam 30 intersects the attachment seam 14. However, one skilled in the art will understand that the waistband 11 may be constructed in a variety of shapes resulting in a variety of attachment seam 14 contours including, but not limited to, a straight horizontal attachment seam contour.

The waistband 11 for the zip-up front fly style pants 10 or other closeable or non-pull-on style pants of the present invention, preferably includes closeable ends. As depicted in FIGS. 1A and 2A, one open end 18 on the left hand side of the waistband 11 preferably includes an aperture 16 formed therein, while the other open end 19 includes a fastener 17, such as a button or other closure, attached thereto to secure the open ends 18 and 19 to one another. Alternatively, other fasteners or closures may be provided to secure or close the open ends 18 and 19.

Figure 2B:
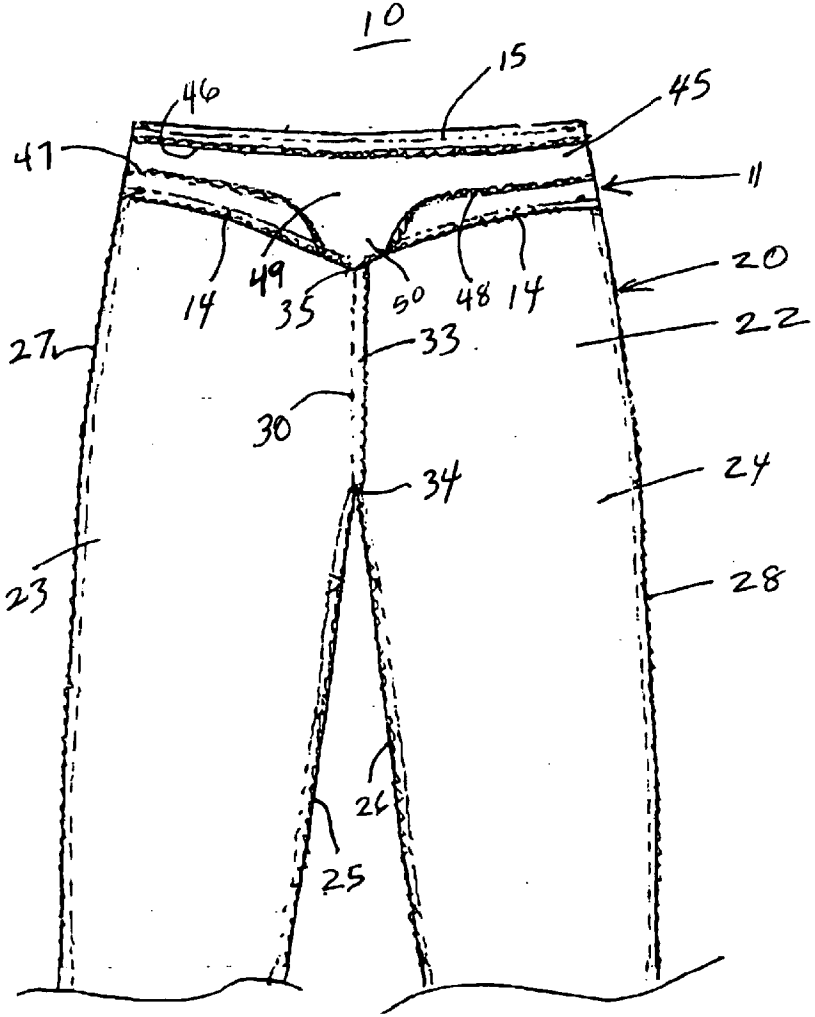
FIGS. 2A and 2B are front and back inside plan views of the pants shown in FIGS. 1A and 1B.
Figure 2A:
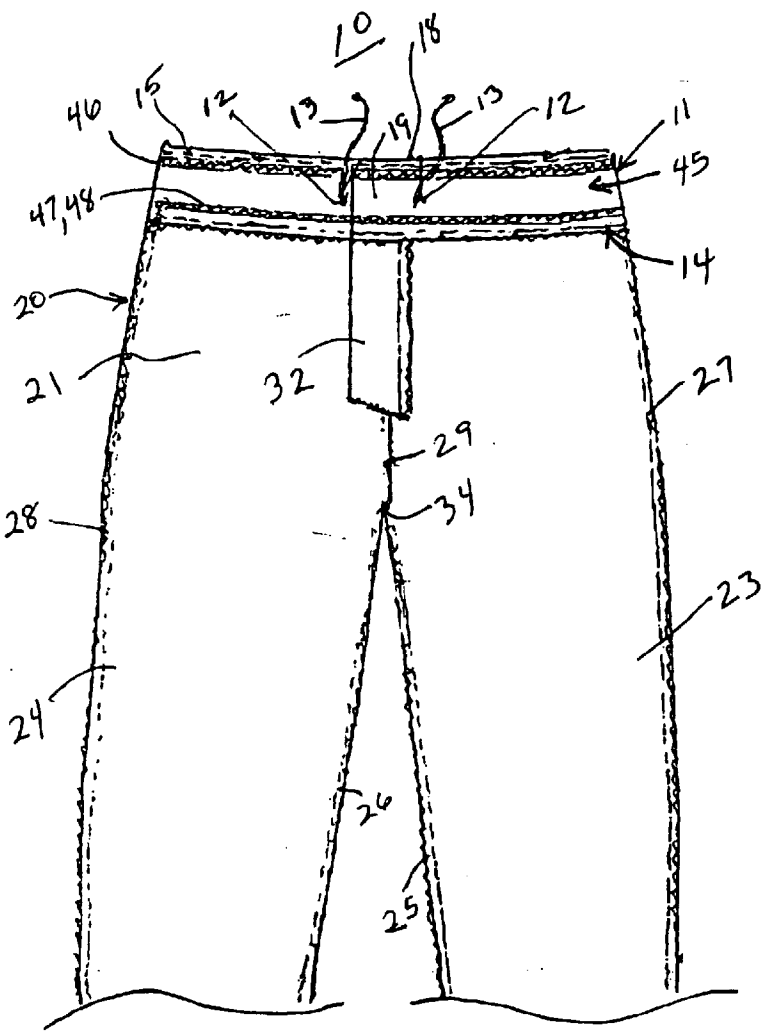

As shown in FIGS. 2A and 2B, which provide inside views of the front 21 and back 22 of the pants 10, the waistband 11 includes a tunnel, channel or casing 45, which is described in greater detail below. The pants 10 also preferably include a back rise tunnel, channel or casing 33 (FIG. 2B) that is formed along the center rear rise seam 30. The back rise tunnel 33 preferably extends from the inseam and rise junction area 34 to the waistband 11 adjacent to the waistband tunnel 45. As depicted, a pair of apertures 12 (FIG. 2A) is preferably formed in the waistband 11 adjacent to its open ends 18 and 19. The apertures enable a drawstring or drawstrings 13 to exit from the waistband tunnel 45. In a preferred embodiment, the drawstring or drawstrings 13 are attached or anchored in the inseam and rise junction area 34 in the interior of the pants 10 and extend upwardly through the back rise tunnel 33 (FIG. 2B) and then through the waistband tunnel 45. Tightening of the drawstring(s) 13 preferably draws the back rise tunnel 33 and rear center rise seam 30 inwardly to define the contours of a wearer's body.

Referring to FIGS. 3A–B and 4A–B, outside and inside views, respectively, of a pair of pull-on style pants 100 of the present invention are provided. Like the zip-up front fly style pants 10 of the present invention, the pull on style pants 100 comprise a waistband 11 connected to a main body 20. The body 20 includes right and left leg portions 23 and 24 that are coupled together forming right and left inseams 25 and 26 and front and rear center rise seams 29 and 30. Although the pants 100 may include side seams, the illustrative embodiment of the pants 100, unlike the zip-up style pants 10 shown in FIGS. 1A–B and 2A–B, does not include side seams. Alternatively, the pants 100 may include side seams and no front and rear center rise seams. Other embodiments of the invention in the form of pants, pants, briefs, swim wear, lingerie, and the like, may be similarly constructed.

Figure 3B:
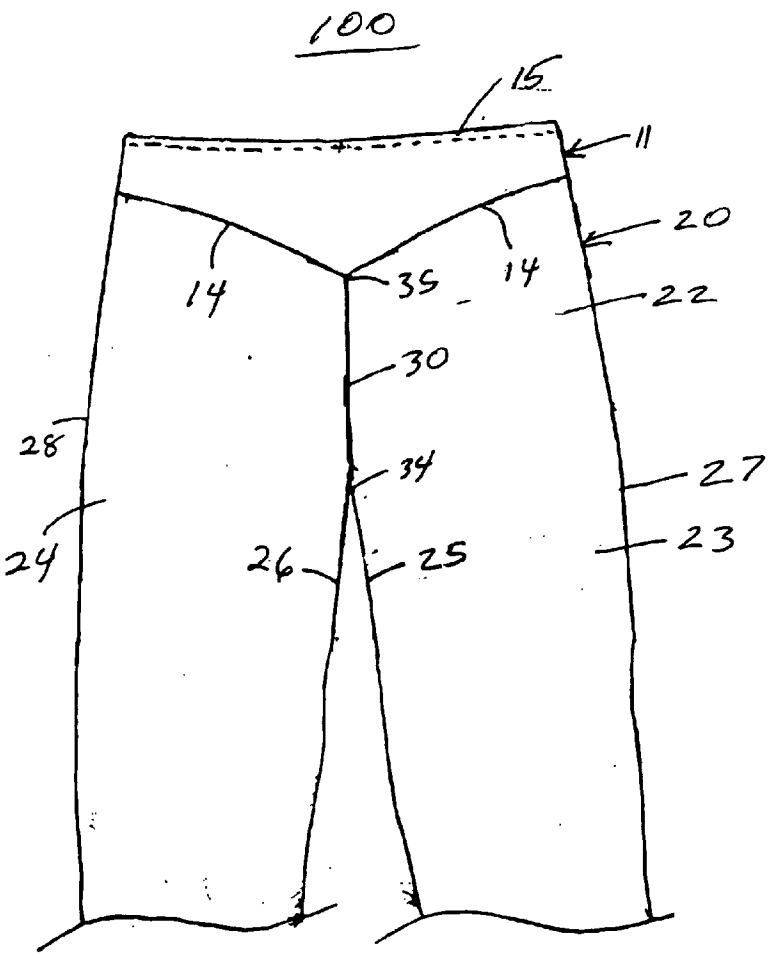
FIGS. 3A and 3B are front and back outside plan views of a pair of pull on style pants in accordance with the present invention.
Figure 3A:
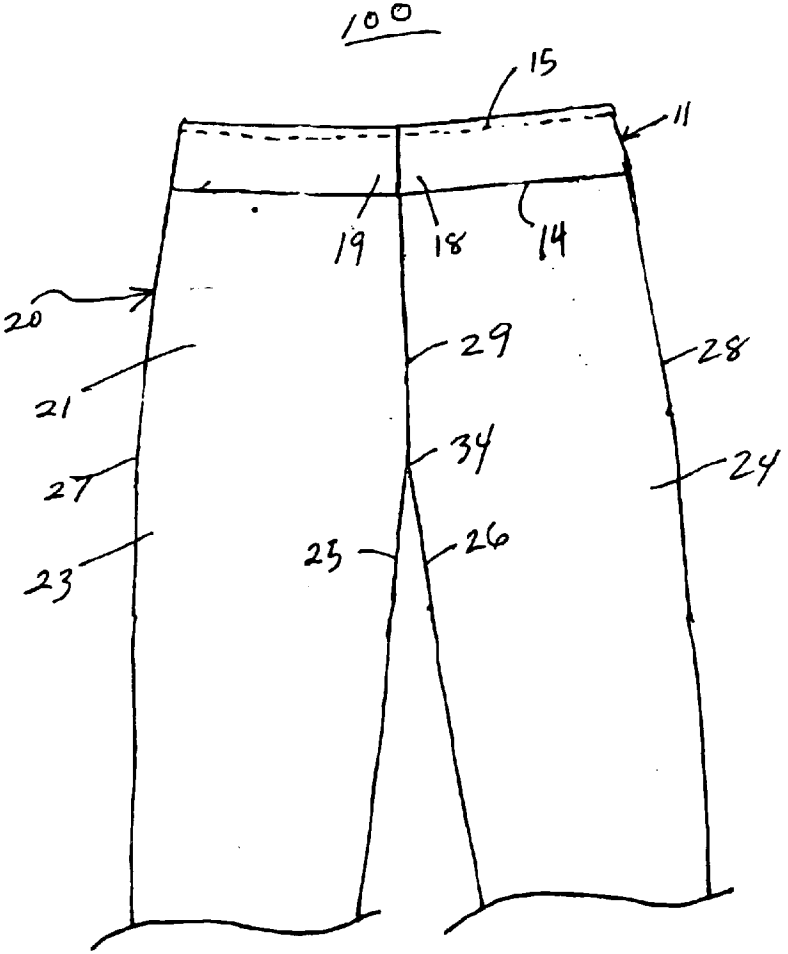

As shown in FIGS. 3A and 3B, the waistband 11 is coupled to the top of the main body 20 of the pants 100 forming an attachment seam 14. The front and rear center rise seams 29 and 30 of the pants 100 extend from an inseam and rise junction area 34, where the right and left inseams 25 and 26 meet, to the attachment seam 14 of the waistband 11. As depicted, the ends 18 and 19 of the waistband 11 are joined together in the front of the garment, but may be joined together anywhere along the waistband 11 such as the sides of the garment.

Figure 4B:
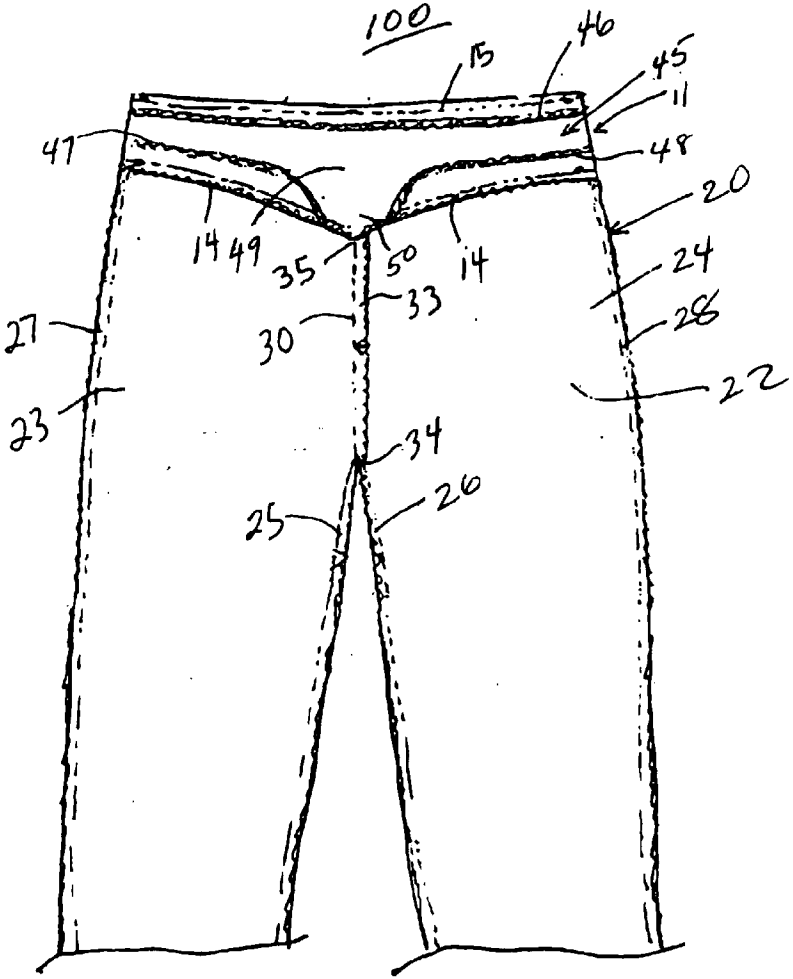
FIGS. 4A and 4B are front and back inside plan views of the pants shown in FIGS. 3A and 3B.
Figure 4A:
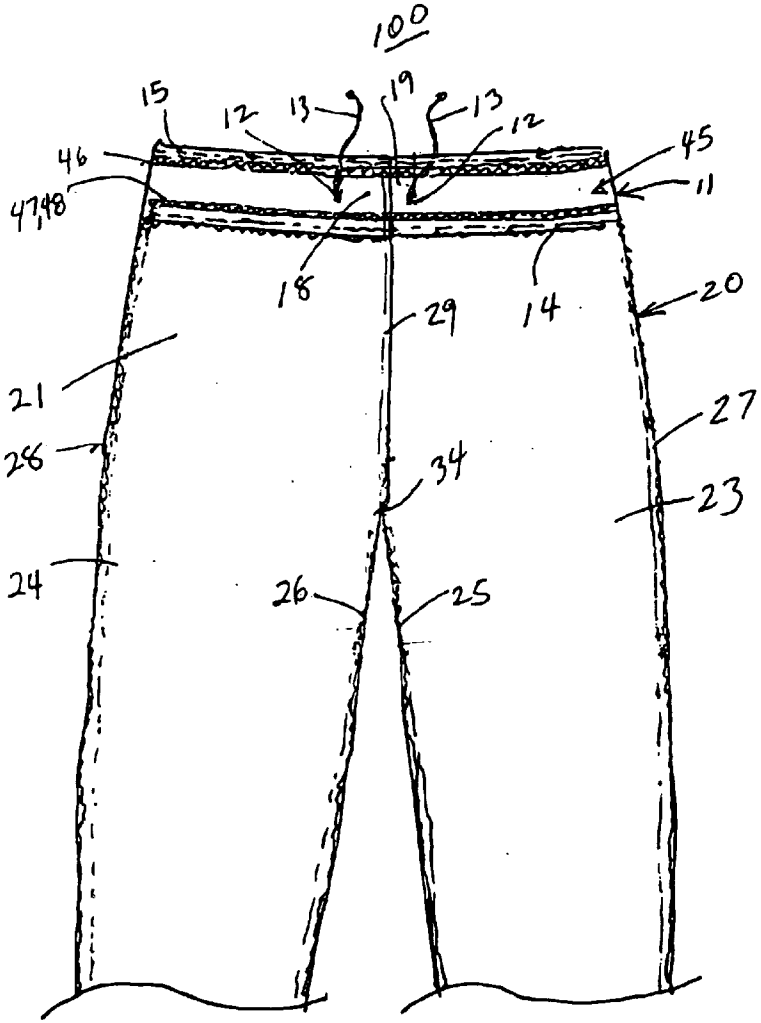

As shown in FIGS. 4A and 4B, which provide inside views of the front and back of the pants 100, the waistband 11 includes a tunnel, channel or casing 45. The pants 100 also preferably include a back rise tunnel, channel or casing 33 (FIG. 4B) that is formed along the center rear rise seam 30. The back rise tunnel 33 preferably extends from the inseam and rise junction area 34 to the waistband 11 adjacent to the waistband tunnel 45. For embodiments that do not include a rear center rise seam, a strip of fabric may be joined to the inside and towards the center of the back 22 of the garment in a manner that forms a tunnel, casing or channel that extends from the inseam and rise junction area 34 to the waistband 11 adjacent to the waistband tunnel 45.

As depicted in FIG. 4A, a pair of apertures 12 is preferably formed in the waistband 11 adjacent the front center rise seam 29. The apertures enable a drawstring and drawstrings 13 to exit from the waistband tunnel 45. As in the zip-up style pants 10 described above, the drawstring or drawstrings 13 are attached or anchored in the inseam and rise junction area 34 in the interior of the pants 100 and extend upwardly through the back rise tunnel 33 (FIG. 4B) and then through the waistband tunnel 45. Tightening of the drawstring(s) 13 draws the back rise tunnel 33 and rear center rise seam 30 inwardly to define the contours of a wearer's body.

Figure 5:
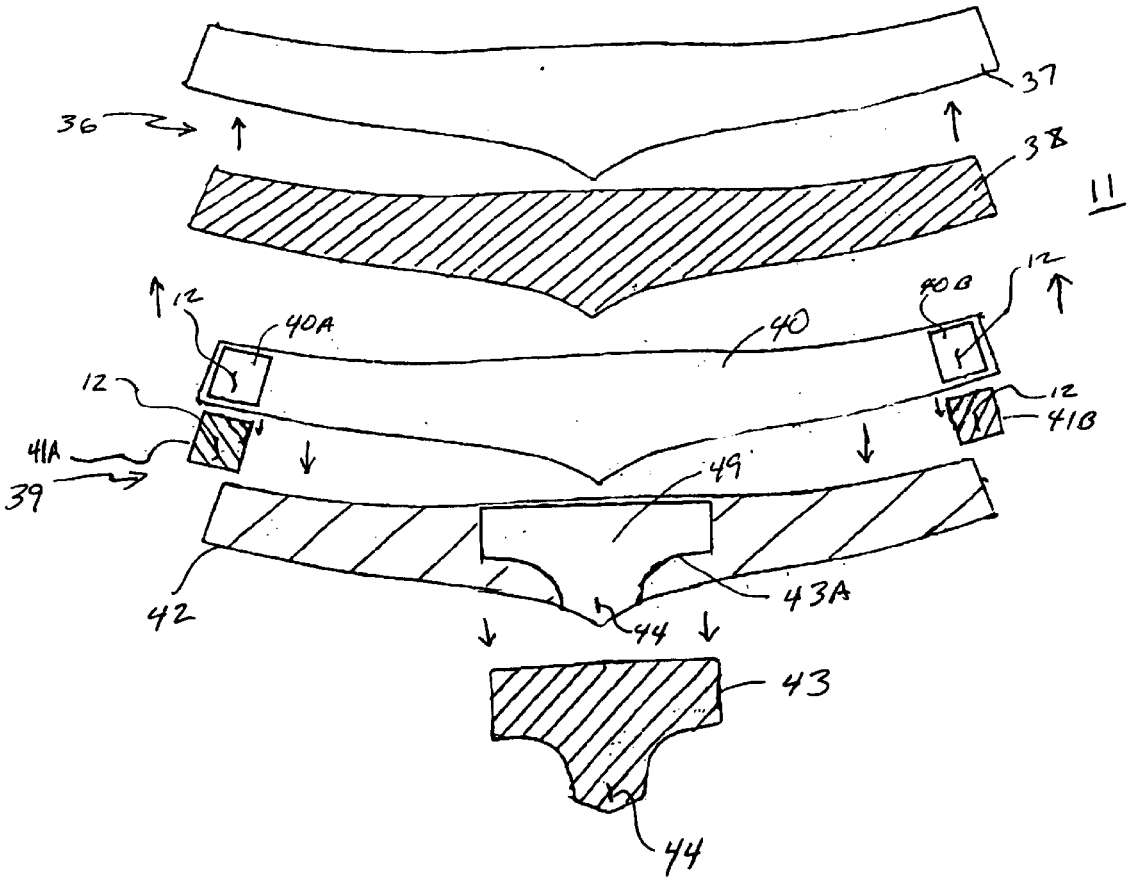
FIG. 5 is an exploded plan view of a waistband in accordance with the present invention.
Figure 6A:
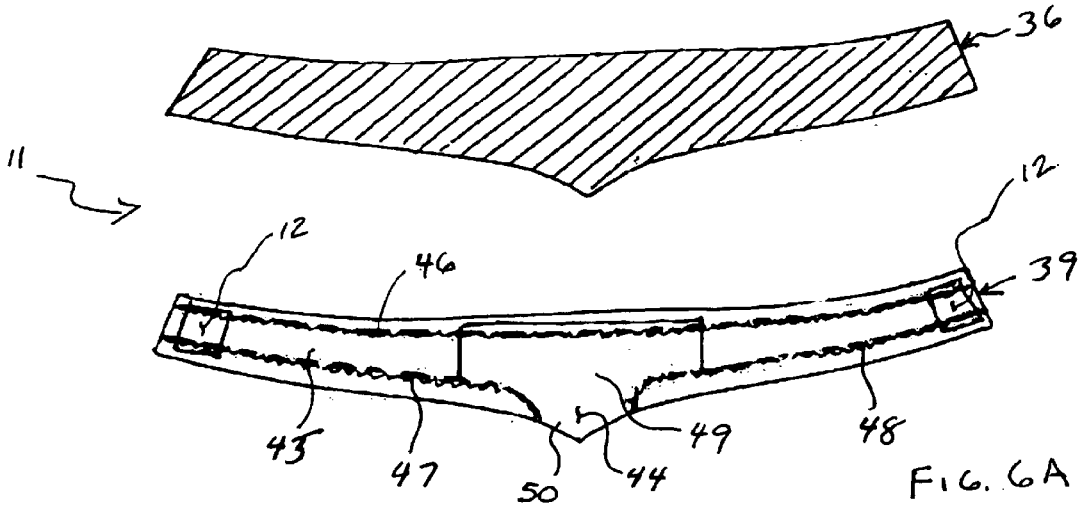
FIG. 6A is a partial exploded plan view of a partially assembled waistband shown in FIG. 5.
Figure 6B:
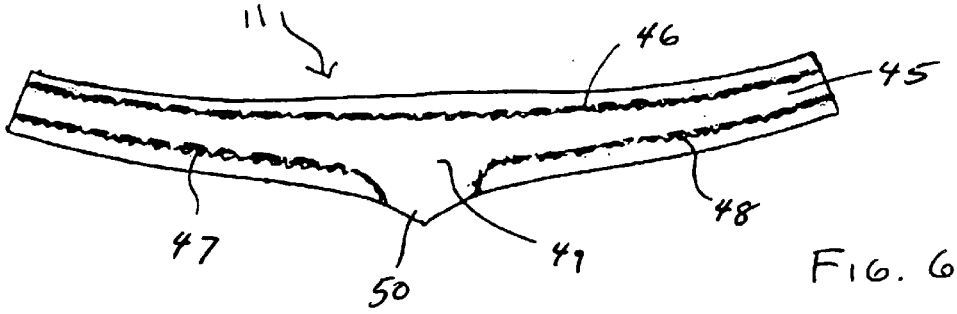
FIG. 6B is a fully assembled plan view of the waistband shown in FIGS. 5 and 6A.

Turning to FIGS. 5 and 6A–B, the novel waistband 11 of the present invention is shown in FIG. 5 in a fully laid open exploded view and in FIGS. 6A–B in a partial exploded view and a fully assembled view, respectively. As shown, the waistband 11 comprises multiple components that facilitate the adjustment of a figure defining and contouring garment while avoiding unsightly bunching or gathering of fabric. As the illustrated embodiment depicts, the waistband 11 comprises a top waistband 36, which is the portion of waistband 11 shown in FIGS. 1A–B and 3A–B, and an under waistband 39, which is the portion of the waistband 11 shown in FIGS. 2A–B and FIGS. 4A–B. As depicted, the width of the top and under waistbands 36 and 39 increases toward the midpoint of the top and under waistbands 36 and 39 such that the bottom edges increasingly slope away from the top edges toward the midpoint of the top and under waistbands 36 and 39.

Referring to FIG. 5, the top waistband 36 preferably comprises a top waistband self or main layer 37 formed from the main fabric of the garment, and a fusing layer 38 coupled to the main layer 37. The fusing layer 38 is preferably formed of a knit or woven adhesive material that is fused to the main layer 37 using heat or steam, or a non-adhesive material that is sewn to the main layer 37. The fusing layer 38 is used as a backing to stabilize or stiffen the main layer 36 and reduce or limit the amount the fabric from which the main layer 37 is formed may stretch or expand.

The under waistband 39 preferably comprises an under waistband self or main layer 40 formed from the main fabric of the garment and a lining layer 42 formed of a knit or woven material typical used as backing on the main fabric of a garment and also in waistbands and pockets. Although shown as separate components in FIG. 5, the top waistband self layer 37 and the under waistband self layer 40 may be formed as a single component that is folded over to act as the main or outer layer of the top and under waistbands 36 and 39.

As discussed below, the waistband tunnel 45 is formed between the main layer 40 and the lining 42 of the under waistband 39 (see FIGS. 6A–B). The apertures 12 discussed above (see FIGS. 2A and 4A) are preferably formed, as shown in FIG. 5, in the main layer 40 of the under waistband 39 adjacent the ends of the main layer 40. As depicted, the under waistband 39 preferably includes fusing patches 41A and 41B affixed to the main layer 40 at fusing outlines 40A and 40B to stabilize the main layer 40 and, thus, the apertures 12 formed therein. The apertures 12 enable the drawstring(s) 13 to exit the waistband tunnel 45 into the interior of the garment.

As shown in FIG. 5, fusing material or a fusing center back band 43 is also preferably affixed to the center of the lining 42 waistband 39 at fusing outline 43A. The fusing center back band 43 is used to stabilize a diverter region 49 of the lining 42 and, thus, the under waistband 39. The fusing center back band 43 tends to substantially fix the diverter region of the lining 42 and a diverter aperture 44 formed therein relative to the inseam and rise junction area 34 of the garment. As a result, when the drawstring shown in FIGS. 1A–4B is tightened it tends to draw the back rise tunnel 33 and rear center rise seam 30 inwardly without drawing the waistband 11 or portions thereof downwardly to cause bunching or gathering in the rear of the garment.

Turning to FIG. 6A, the top waistband self layer 37 and fusing layer 38 shown in FIG. 5 are combined to form the top waistband 36. The under waistband self layer 40, fusing patches 41 A–B, lining layer 42 and fusing center back band 43 shown in FIG. 5 are also combined to form the under waistband 39. Once combined, a cover stitch detail comprising an upper or top cover stitching 46 and lower or bottom left and right cover stitching 48 and 47 is added to the under waistband 39 to form a generally y-shaped diverter region 49 and the tunnel, channel or casing 45 between the under waistband self layer 40 and the lining 42. The diverter region 49 is located toward the center of the under waistband 39 and the tunnel 45 extends from the diverter region 49 toward the ends of the under waistband 39. The diverter aperture 44 is preferably located in the lower stem portion 50 of the diverter region 49 at a predetermined distant below the waistband tunnel 45 sufficient to advantageously provide a sloping or tapering transition for the drawstring 13 as it enters the diverter region 49 through the diverter aperture 44 and extends into the waistband tunnel 45. With the sloping or tapering transition, the diverter region 49 tends to balance or distribute the load applied to the waistband 11 when the drawstring is tightened and, thus, further facilitates adjusting the garment while avoiding bunching or gathering of the fabric in the rear of the garment.

As shown in FIG. 6B, the top and under waistbands 36 and 39 are joined to form the waistband 11. Preferably, elastic or some other stretch trim material to secure comfort, fit and flexibility, is interposed between the top and under waistbands 36 and 39. Once combined, the waistband 11 is attached to the body 20 of the garment as shown in FIGS. 1A–4B.

The zip-up and pull on style pants 10 and 100 and other embodiments of the present invention are preferably constructed in accordance with the present invention as follows. Referring to FIGS. 5–6B, the fusing layer 38 is first fused to the top waistband self layer 37 to form the top waistband 36. Next, the fusing patches 41 are fused to the under waistband self layer 40 adjacent its ends and the fusing center back band 43 is fused to center of the lining layer 42. The front apertures 12 are then marked and formed in the under waist band self layer 40 adjacent the ends of the layer 40 and the diverter aperture 44 is marked and formed in the lower stem portion 50 of the diverter region 49 of the lining 42. After forming the apertures 12, the under waistband self layer 40 and lining 42 are combined with an overlock stitch at the top of the under waistband 39. The waistband casing, channel or tunnel 45 (FIG. 6A) is then formed between the under waistband self layer 40 and the lining 42 of the under waistband 39 by applying the top and bottom cover stitch details 46, 47 and 48 to the under waistband 39. Next, the top of the waistband 11 is closed by joining the top and under waistbands 36 and 39 at a top seam 15 shown in FIGS. 1A–4B. When combined, the top waistband self layer 37 and under waistband self layer 40 form the outer layers or surface of the waistband 11. As a result, the diverter aperture 44 is advantageously internally hidden within the waistband 11.

Referring now to FIGS. 1A–4B, with the waistband 11 formed, the front and rear center rises are closed forming the front and rear center rise seams 29 and 30. For the zip-up front fly style pants 10 shown in FIGS. 1A–2B, the front fly 31 is attached at the front center rise seam 29 at the left hand side and the fly extension 32 is attached at the front center rise seam 29 at the right hand side. Next, the edge of the center rear rise seam 30 is over-locked to create the back rise tunnel, channel or casing 33 (FIGS. 2B and 4B). The drawstring 13 is then inserted into the back rise tunnel 33 and anchored in the inseam and rise junction area 34. The right and left inseams 25 and 26 are then closed front 21 to back 22, and for garments with side seams, the right and left side seams 27 and 28 are also closed front 21 to back 22. The lower edge of the top waistband 36 is then attached to the body 20 of the garment forming attachment seam 14 as shown in FIGS. 1A–B and 3A–B. For the pull-on style pants 100 shown in FIGS. 3A–4B, the ends 18 and 19 of the waistband 11 are then closed.

With the top waistband 36 attached to the body 20, the drawstring 13 is inserted into the diverter region 49 through the diverter aperture 44. First and second ends of the drawstring 13 are directed to the right and left from the diverter region 49 into the waistband tunnel 45 and toward the front of the waistband 11 where they are directed out of the apertures 12. The waistband 11 is then closed to the body 20 by attaching the lower edge of the under waistband 39 to the body 20 forming the attachment seam 14 shown in FIGS. 2A–B and 4A–B. As depicted in FIGS. 2B and 4B, the lower stem portion 50 of the diverter region 49 of the under waistband 39 preferably overlaps the upper end of the back rise tunnel 33 and, thus, advantageously hides the transition of the drawstring 13 between the back rise tunnel 33 and the waistband tunnel 45.

For the zip-up front-fly style pants 10 shown in FIGS. 1A–2B, the front aperture 16 is then marked and formed in the waistband 11 adjacent its front left-hand end 18 and the button 17 is attached to the waistband 11 adjacent its front right-hand end 19. Alternatively, other fasteners or closures may be attached to the front ends 18 and 19 of the waistband 11.

In operation, a wearer puts on a figure defining and contouring garment according to the present invention, such as the zip-up and pull on style pants 10 and 100 described above, and adjusts the fit of the garment by pulling on the drawstring 13 at the front of the garment to tighten the drawstring 13. Because the diverter aperture 44 and, thus, the diverter region 49 of the waistband 11 tend to be substantially fixed relative the inseam and rise junction area 34 of the garment, tightening of the drawstring 13 causes the back rise tunnel 33 and the center rear rise seam 30 to be drawn in to define the contours of the wearer's body.

Figure 7A:
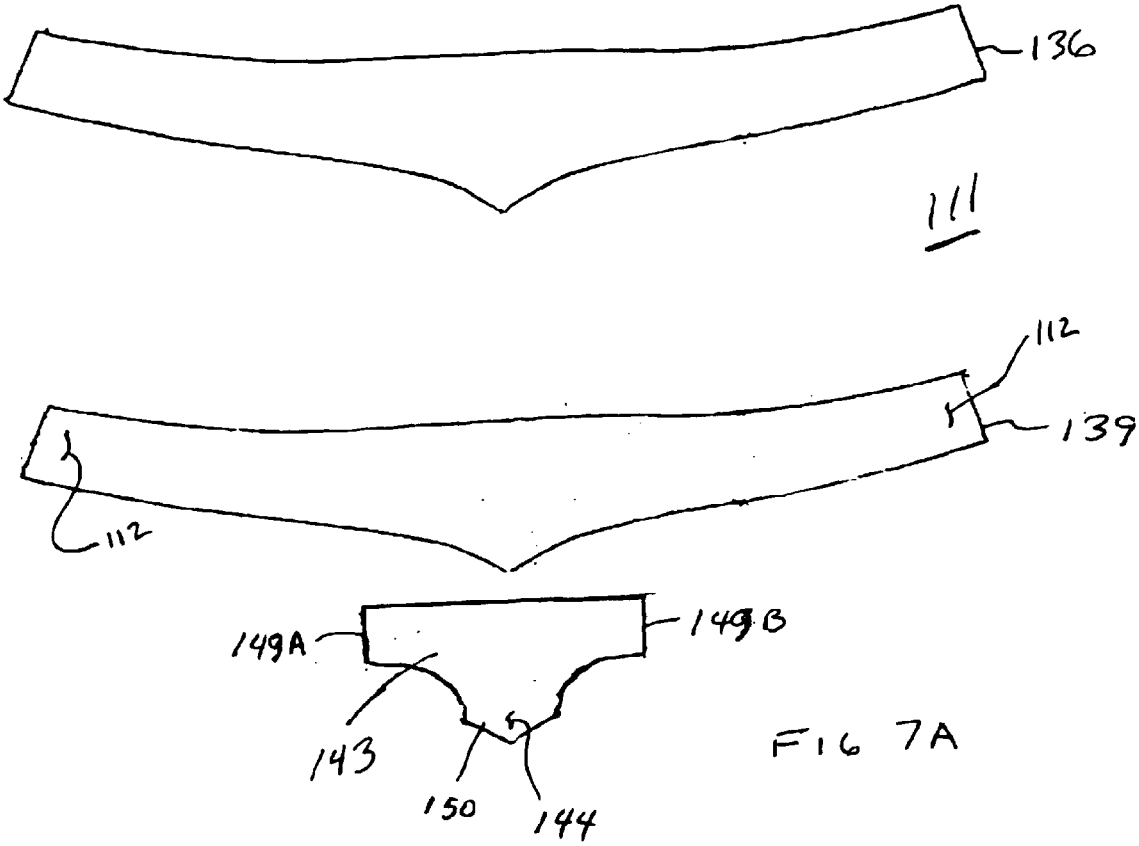
FIG. 7A is an exploded view of an alternate embodiment of a waistband in accordance with the present invention.
Figure 7B:
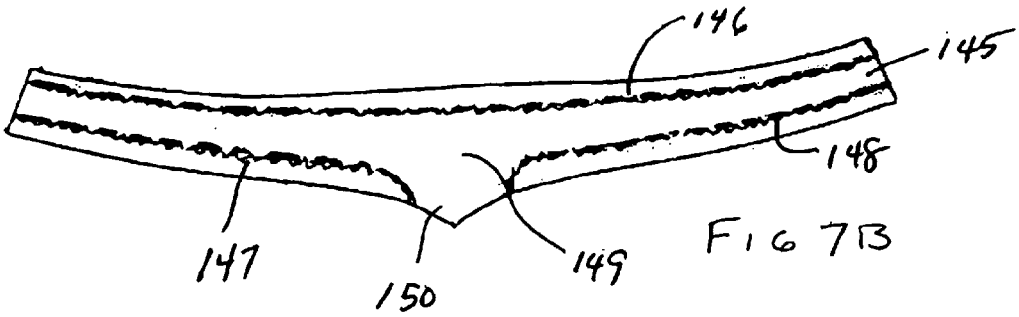
FIG. 7B is a fully assembled view of the waistband shown in FIG. 7A.

Turning now to FIGS. 7A and 7B, in an alternate embodiment, the waistband 111 may be comprised of fewer components than previously described. For example, the top waistband 136 may preferably comprise a single layer of material, especially if the waistband self is sufficiently stable or stiff. Further, instead of forming a tunnel, channel or casing between a main layer and lining of an under waistband component of a waistband, the tunnel 145 may be formed between the top waistband 136 and an under waistband 139, which, as depicted, may preferably comprise a single layer of material. The waistband tunnel 145, as shown in FIG. 7B, may be constructed by applying a cover stitch detail comprising top and bottom cover stitching 146, 147 and 148 to the waistband 111. In a preferred embodiment, the waistband 111 would also include a center back band diverter 143 formed from a material sufficiently stiff to stabilize the waistband 111 and substantially fix a diverter aperture 144 relative to an inseam and rise junction area of a garment. The diverter 143 is preferably attached about its edges, with the exception of its upper side edges 149A and 149B, to the under waistband 139 and interposed between the top and under waistbands 136 and 139 when they are combined to form the waistband 111.

When the waistband 111 is incorporated into a figure defining and contouring garment of the present invention, a drawstring extends into a diverter region between the under waistband 139 and the diverter 143 through the diverter aperture 144 formed in the diverter 143. The ends of the drawstring extend out the sides 149A and B of the diverter 143, through the waistband tunnel 145, and exit the tunnel 145, preferably in the front of the garment, through apertures 112 formed in the under waistband 139.

When the alternate embodiment waistband 111 is incorporated into the zip-up and pull on style pants 10 and 100 shown in FIGS. 1A–4B (in place of waistband 11), the pants are preferably constructed in accordance with the present invention as follows. Referring to FIGS. 7A–B, the center back band diverter 143 is sewn about its exterior edges, with the exception of its side edges 149A–B, to the center back of the under waistband 139. The front apertures 112 are then marked and formed in the under waist band 139 adjacent to the ends of the under waistband 139 and the diverter aperture 144 is marked and formed in the lower stem portion 150 of the diverter 143. After forming the apertures, the top of the waistband 111 is closed by joining the top and under waistbands 136 and 139 at a top seam 15 shown in FIGS. 1A–4B. When the top and under waistbands 136 and 139 are joined, the diverter 143 and, thus, the diverter aperture 144 are advantageously internally hidden within the waistband 111.

The front and rear center rises are then closed forming the front and rear center rise seams 29 and 30 as shown in FIGS. 1A–4B. For the zip-up front fly style pants 10 shown in FIGS. 1A–2B, the front fly 31 is attached at the front center rise seam 29 at the left hand side and the fly extension 32 is attached at the front center rise seam 29 at the right hand side. Next, the edge of the center rear rise seam 30 is overlooked to create the back rise tunnel, channel or casing 33. The drawstring 13 is then inserted into the back rise tunnel 33 and anchored in the inseam and rise junction area 34. The right and left inseams 25 and 26 are then closed front 21 to back 22 and, for garments with side seams, the right and left side seams 27 and 28 are also closed front 21 to back 22. The lower edge of the top waistband 136 is then attached to the body 20 of the garment forming an attachment seam 14 shown in FIGS. 1A–B and 3A–B. The waistband casing, channel or tunnel 145 is then formed between the under waistband 139 and the top waistband 136 by applying the top and bottom cover stitch details 146, 147 and 148 to the waistband 111. The drawstring 13 is then inserted into the diverter region through the diverter aperture 144. First and second ends of the drawstring 13 are directed to the right and left from the diverter region into the waistband tunnel 145 and toward the front of the waistband 111 where they are directed out of the apertures 112. The waistband 111 is then closed to the body 20 by attaching the lower edge of the under waistband 139 to the body 20 forming the attachment seam 14 shown in FIGS. 2A–B and 4A–B. For the pull-on style pants 100 shown in FIGS. 3A–4B, the ends of the waistband 111 are also closed. As depicted in FIGS. 2B and 4B, the lower stem portion 150 of the diverter 143 and the under waistband 139 preferably overlaps the upper end of the back rise tunnel 33 and, thus, advantageously hides the transition of the drawstring 13 between the back rise tunnel 33 and the waistband tunnel 145.

In operation, a wearer puts on a figure defining and contouring garment according to the present invention, such as the zip-up and pull on style pants 10 and 100 described above with the alternate embodiment waistband 111, and adjusts the fit of the garment by pulling on the drawstring 13 to tighten the drawstring 13. Because the diverter aperture 144 and, thus, the diverter region of the waistband 111 tend to be substantially fixed relative the inseam and rise junction area of the garment, tightening of the drawstring 13 causes the back rise tunnel 33 and the center rear rise seam 30 to be drawn in to define the contours of the wearer's body.

Thus, the figure defining and contouring garment provides many benefits over the prior art. While the above description contains many specifics, these should not be construed as limitations on the scope of the invention, but rather as an exemplification of preferred embodiments thereof. Many other variations are possible.

Accordingly, the scope of the present invention should be determined not by the embodiments illustrated above, but by the claims and their legal equivalents.

What is claimed is:

1. An adjustable garment comprising:

a body:

a waistband coupled to the body, the waistband comprises a diverter region that includes a stabilizing layer and is substantially fixed relative to a crotch region of the body;

a rear tunnel extending upwardly from the crotch region alone an inside of a rear of the body;

a waistband tunnel formed in the waistband; and a drawstring anchored in the crotch region and extending upwardly through the rear tunnel and transitioning into and extending through the waistband tunnel, wherein a drawstring transition between the rear and waistband tunnels is disposed within the waistband;

wherein the stabilizing layer comprises fusing material.

2. The garment of claim 1 wherein the body further comprises a rear center rise seam and wherein the rear tunnel is formed along the rear center rise seam.

3. The garment of claim 2 wherein the waistband comprises a top waistband and an under waistband.

4. An adjustable garment comprising:

a body;

a waistband coupled to the body, wherein the waistband comprises a top waistband and an under waistband, wherein the under waistband comprises first and second layers, and wherein the second layer is interposed between the first layer and the top waistbands;

a rear tunnel extending upwardly from a crotch region along an inside of a rear of the body;

a waistband tunnel formed in the waistband; and a drawstring anchored in the crotch region and extending upwardly through the rear tunnel and transitioning into and extending through the waistband tunnel, wherein a drawstring transition between the rear and waistband tunnels is disposed within the waistband.

5. The garment of claim 4 wherein the waistband further comprises a diverter region.

6. The garment of claim 5 wherein the diverter region is substantially fixed relative to the crotch region.

7. The garment of claim 6 wherein the diverter region includes a stabilizing layer.

8. The garment of claim 4 wherein the waistband tunnel is formed between the first and second layers of the under waistband.

9. The garment of claims 8 wherein an aperture is formed in the second layer and opening into the waistband tunnel.

10. The garment of claim 9 wherein the under waistband overlaps a top end of the rear tunnel.

11. The garment of claim 9 further comprising a third layer joined to the second layer in a diverter region of the waistband.

12. The garment of claim 4 wherein the body further comprises a rear center rise seam and wherein the rear tunnel is formed along the rear center rise seam.

13. An adjustable garment comprising:

a body having a crotch region;

a waistband coupled to the body, the waistband comprises a diverter region that is substantially fixed relative to the crotch region and includes a stabilizing layer, wherein the stabilizing layer comprises fusing material;

a back tunnel extending upwardly from a first point in the crotch region of the body along an inside of a back portion of the body to a second point in the waistband, wherein the second point is substantially fixed relative to the first point, a drawstring anchored adjacent the first point in the crotch region of the body and extending upwardly through the back tunnel to the second point, and an upper tunnel, wherein the drawstring transitions from the back tunnel into the upper tunnel, the diverter region diverting the drawstring to the upper tunnel, and extends through the upper tunnel.

14. The garment of claim 13 wherein a drawstring transition between the back and the upper tunnels is hidden from view.

15. The garment of claim 13 wherein the body further comprises a rear center rise seam and wherein the back tunnel is formed along the rear center rise seam.

16. The garment of claim 13 wherein the waistband comprises a top waistband and an under waistband.

17. An adjustable garment comprising:

a body having a crotch region;

a waistband coupled to the body, wherein the waistband comprises a top waistband and an under waistband, and wherein the under waistband comprises a self layer and a lining layer, wherein the lining layer is interposed between the self layer and the top waistband;

a back tunnel extending upwardly from a first point in the crotch region of the body along an inside of a back portion of the body to a second point in the waistband, wherein the second point is substantially fixed relative to the first point, a drawstring anchored adjacent the first point in the crotch region of the body and extending upwardly through the back tunnel to the second point, an upper tunnel, wherein the drawstring transitions from the back tunnel into the upper tunnel and extends through the upper tunnel.

18. The garment of claim 17 wherein the waistband further comprises a diverter region diverting the drawstring to the upper tunnel.

19. The garment of claim 18 wherein the diverter region is substantially fixed relative to the crotch region.

20. The garment of claim 19 wherein the diverter region includes a stabilizing layer.

21. The garment claim 17 wherein the upper tunnel is formed between the self and lining layers of the under waistband.

22. The garment of claim 21 wherein an aperture is formed in the lining layer and opening into the upper tunnel.

23. The garment of claim 22 wherein the under waistband overlaps a top end of the back tunnel.

24. The garment of claim 23 further comprising a fusing layer joined to the lining layer in a diverter region of the waistband.

25. The garment of claim 20 wherein the stabilizing layer comprises fusing material.

26. The garment of claim 17 wherein a drawstring transition between the back and the upper tunnels is hidden from view.

27. The garment of claim 17 wherein the body further comprises a rear center rise seam and wherein the back tunnel is formed along the rear center rise seam.

* * * * *

UNITED STATES PATENT AND TRADEMARK OFFICE

CERTIFICATE OF CORRECTION

PATENT NO. : 6,839,913 B2
APPLICATION NO. : 10/180481
DATED : January 11, 2005
INVENTOR(S) : Ora Zoe Villalobos It is certified that error appears in the above-identified patent and that said Letters Patent is hereby corrected as shown below:

Column 9, line 2, change “alone” to --along--.

Signed and Sealed this

Thirteenth Day of February, 2007

JON W. DUDAS
*Director of the United States Patent and Trademark Office*